US005820501A

United States Patent [19]

Soofi

[11] Patent Number: 5,820,501

[45] Date of Patent: Oct. 13, 1998

[54] BALL ENVELOPE

[75] Inventor: Khurshid Ahmed Soofi, Sialkot, Pakistan

[73] Assignee: Saga Sports (PVT) Ltd., Sialkot, Pakistan

[21] Appl. No.: 854,432

[22] Filed: May 12, 1997

Related U.S. Application Data

[63] Continuation of Ser. No. 533,998, Sep. 27, 1995, abandoned.

[30] Foreign Application Priority Data

Sep. 29, 1994 [DE] Germany ..... 44 34 751.0

[51] Int. Cl.[6] ..... A63B 41/08

[52] U.S. Cl. ..... 473/599; 473/604

[58] Field of Search ..... 473/593, 598, 473/599, 603, 604, 605, 606, 607, 608, 609, 610, 144, 148, 158

[56] References Cited

FOREIGN PATENT DOCUMENTS

| | | | |
|---|---|---|---|
| 363800 | 11/1922 | Germany | 273/58 BA |
| 687 750 | 10/1939 | Germany . | |
| 3726830 C1 | 12/1988 | Germany . | |
| 89 08 027.0 | 11/1989 | Germany . | |
| 1711930 | 2/1992 | U.S.S.R. | 273/65 E |
| 435352 | 9/1935 | United Kingdom | 273/65 E |
| 1387930 | 9/1974 | United Kingdom | 273/65 R |

*Primary Examiner*—Mark S. Graham
*Attorney, Agent, or Firm*—Townsend and Townsend and Crew LLP

[57] ABSTRACT

A ball envelope made up of a plurality of polygonal segments sewn together at their edges. The polygonal segments are made up of first and second groups of segments having different shapes. The first group of polygonal segments is made up of equilateral, triangular segments, while the second group of polygonal segments is made up of hexagonal segments. The hexagonal segments have an outline corresponding to a rectangle interposed between two isosceles triangles, with the short sides of the rectangle coinciding with the bases of the isosceles triangles. The long sides of the rectangles of each hexagonal segment are connected to edges of the triangular segments, while sides of the isosceles triangles of each hexagonal segment are connected to sides of the isosceles triangles of other hexagonal segments.

10 Claims, 6 Drawing Sheets

BALL ENVELOPE

This is a Continuation of application Ser. No. 08/533,998, filed Sep. 27, 1995 now abandoned, the disclosure of which is incorporated by reference.

BACKGROUND OF THE INVENTION

1. Technical Field

The present invention relates to a ball envelope, in particular for soccer balls, made up of a plurality of polygonal segments sewn together at the edges and which belong to two groups of different shape whereby the first group is made up of equilateral triangular segments and the second group is made up of hexagonal segments.

2. Description of the Prior Art

These types of envelope normally consist of groups of differently shaped segments which are connected or sewn together in such a way that a round ball is formed. Furthermore, it is usual to use two groups of different segments with a total of 18 or 32 individual segments whereby size and design of the individual segments are to be selected so that the resulting ball fulfill the dimensions required by the international soccer organization (FIFA), in particular in respect of the circumference, which must be between 68 cm and 72 cm.

Due to the above-mentioned prerequisites, the segments are always polygonal, for example pentagonal and/or hexagonal. The individual segments are sewn together at the edges with the sewing being principally carried out manually, since mechanical sewing cannot be performed or, at least, not in a cost-effective manner.

Reference is made to German patent application 37 26 830 and the initial remarks mentioned therein about the existing difficulties. In addition, it is to be mentioned that not only the roundness of the ball but also the weight distribution of the individual segments must be balanced so that the ball keeps to the expected flight curve when it is kicked.

Of course, the manufacturers of such balls have tried to achieve the optimum combination for the distribution of the segments of the ball. It has turned out, however, that improvement of one requirement resulted in deterioration of another.

SUMMARY OF THE INVENTION

The task of the present invention is therefore to present a ball envelope as initially described which is improved in respect of the aforementioned problems without having to accept disadvantages in respect of other requirements, so that a substantially ideal ball is created and no loss in quality has to be accepted.

This task, according to the present invention, is achieved in that the hexagonal segments have the form of a rectangle with a triangle added to each one of the two opposing sides thereof, whereby one side of each triangle folds together with the associated side of the rectangle and the two other sides of the triangle match with one another as well as with the corresponding sides of the respective other triangle.

If the segments are designed in this way it is advantageous to use a total of twenty segments with twelve hexagonal segments and eight triangular segments being used for each ball envelope and with an area ratio of both segments of 1:1, contrary to all known ball envelopes.

On the basis of the features of the present invention a ball envelope can be formed, in which each side of a triangular segment is sewn to a longitudinal side of a hexagonal segment so that each triangular segment is surrounded by three hexagonal segments and on each end of the hexagonal segment the four apexes of the hexagonal segments coincide. When all abutting edges are sewn together a substantially ideal ball envelope is formed, in particular for a soccer ball.

The edges of the triangular segments are preferably shaped slightly convex.

Another embodiment of the invention is characterized by the fact that the hexagonal segments have a triangular cutout placed in one of the two sides of the rectangle portion of the hexagonal segment between the two triangle portions thereof and having a shape complementing the corners of the triangular segments. The exact arrangement of both groups of segments will be described in the following description of an example of an embodiment of the invention.

The invention being described offers many significant advantages, not all of which are listed below, in respect to the prior art.

The use of twenty individual segments enables the optimum arrangement of both groups of segments, that is to say twelve hexagonal segments and eight triangular segments whereby a rounder ball is formed than a ball forming with eighteen or thirty-two segments. In addition, compared to ball envelopes with thirty-two segments, material is saved during punching, which also results in cost-saving. Furthermore, it is of importance that the individual segments are sewn together manually—as already mentioned above—so that, since less individual segments are used, a greater number of ball envelopes per unit of time can be produced without giving rise to any disadvantages. Although—compared to balls with 32 individual segments—many manufacturing processes can be avoided if eighteen individual segments are used, considerable disadvantages will however result.

A further advantage of the new ball envelope is that, due the equal surface size of both groups of individual segments, no extension problems of the ball during inflation arise. Furthermore, the equal surface size of the segments enables an adaptation of the ball circumference to the FIFA requirement of a circumference of between 68 cm and 72 cm. During inflation of the ball, a uniform expansion pressure prevails in all parts of the ball so that the ball achieves a rounder form than would be the case with segments of differing surfaces. Furthermore, the larger surface area of the individual segments, brought about by using only twenty segments, leads to a better bouncing behavior of the ball, upon bouncing of the ball a larger area is dented than with the use of small segments, which means that more potential energy is stored, which is then converted into a higher amount of kinetic energy.

In addition, the shapes of the two groups of segments according to the present invention, lead to shorter seams as a whole and to shorter seams on the edges of the segments. This, however, is of importance since the highest degree of abrasion of the ball occurs there. Furthermore, it must be pointed out that the weight and the thickness of the individual segments play a significant role. These properties have been taken into account in this invention and they have been designed so that the ball offers ideal conditions during playing.

A further important advantage of the ball envelope according to the present invention is that, if it is kicked in the hard area which lies—due the great number of stitches—around the three triangular segments, the ball will better reach the point at which it is aimed. Due to its perfect roundness and the balance of the segments on the circumference of the ball envelope, the ball does not deviate from its flight curve. If a ball is not perfectly round and balanced, the kicked ball normally flutters in the air. The ball, according to the present invention, allows a controllable curve and reaches the point at which it is aimed without deviating from the curve. Due to the perfect roundness of the ball according to the invention, it achieves higher speed than common balls.

As already stated, a smaller number of stitches is required for the ball envelope according to the present invention so that a smaller quantity of sewing thread is required. This also means that more ball envelopes can be produced per unit of time so that manufacturing costs can be reduced.

DETAILED DESCRIPTION OF THE PREFERRED EXEMPLARY EMBODIMENTS

Figure 1:
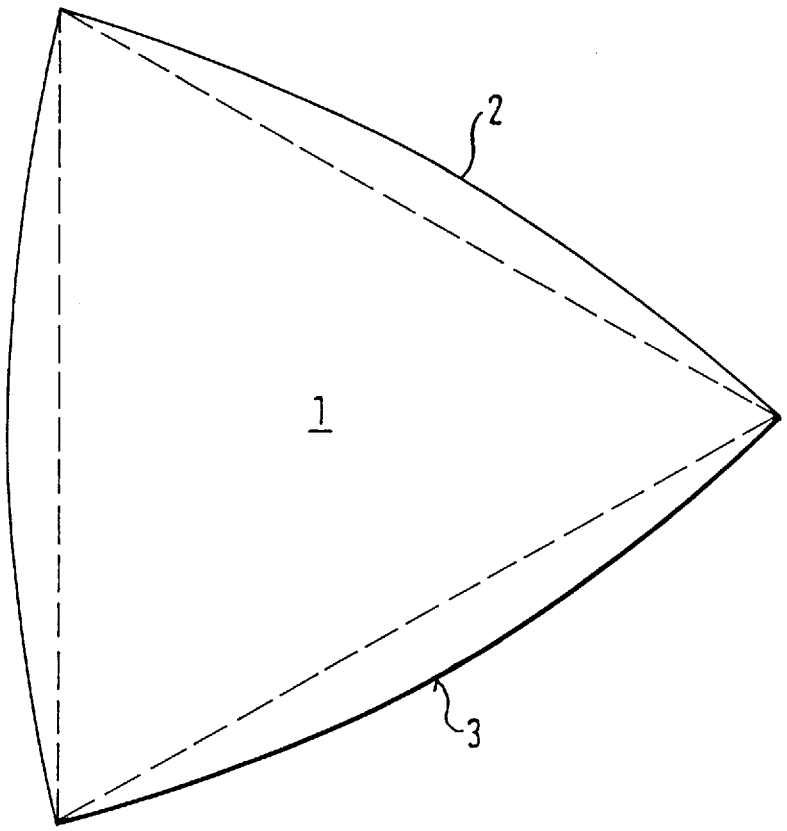
FIG. 1 is an elevation view of a triangular segment of a first group of segments for the formation of a ball envelope according to the present invention.

FIG. 1 shows a triangular segment 1 having equilateral sides 2. The edges 3 of the equilateral triangle 1 are slightly convex, with the convexity being somewhat enlarged for illustrative reasons.

Figure 2:
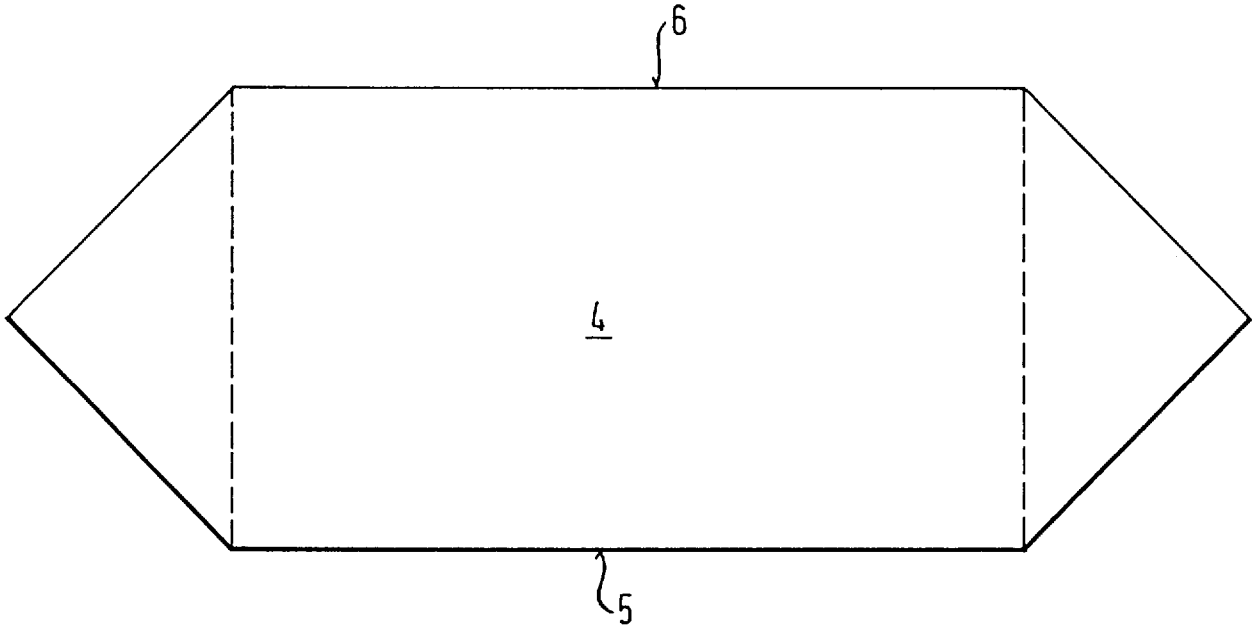
FIG. 2 is an elevation view of a hexagonal segment of a second group of segments for the formation of a ball envelope according to the present invention.

FIG. 2 shows a hexagonal segment formed such that a triangle is added to two opposing sides of a rectangle whereby one side of each triangle folds together with the associated side of the rectangle and the two other sides match with one another, as well as with the corresponding sides of the respective other triangle. The longitudinal edges 5 and 6 of this hexagonal segment 4 are combined and sewn together with edges 3 of the triangular segment 1.

Figure 3:
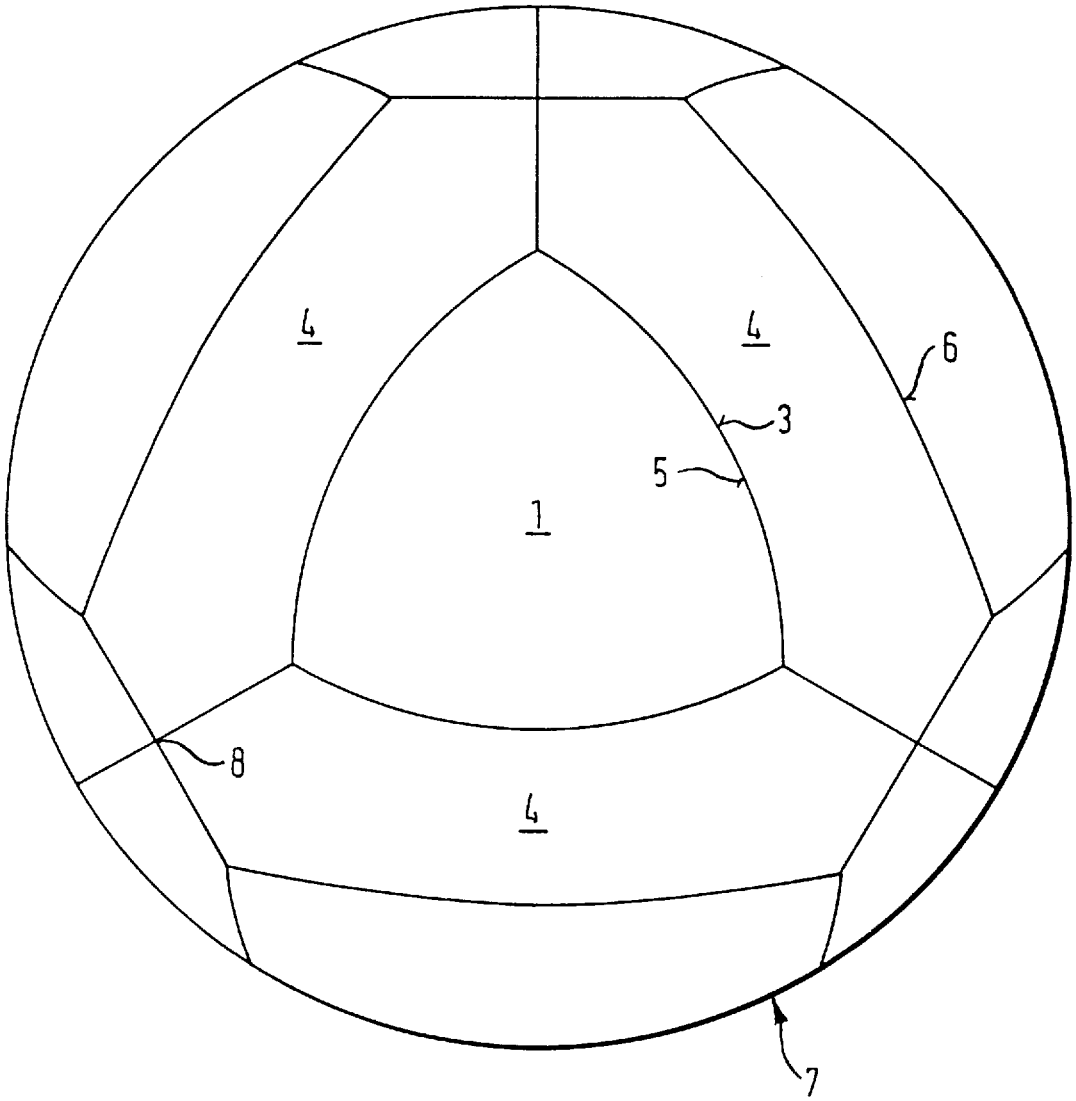
FIG. 3 is a plan view of a ball consisting of the segments according to FIGS. 1 and 2.
Figure 4:
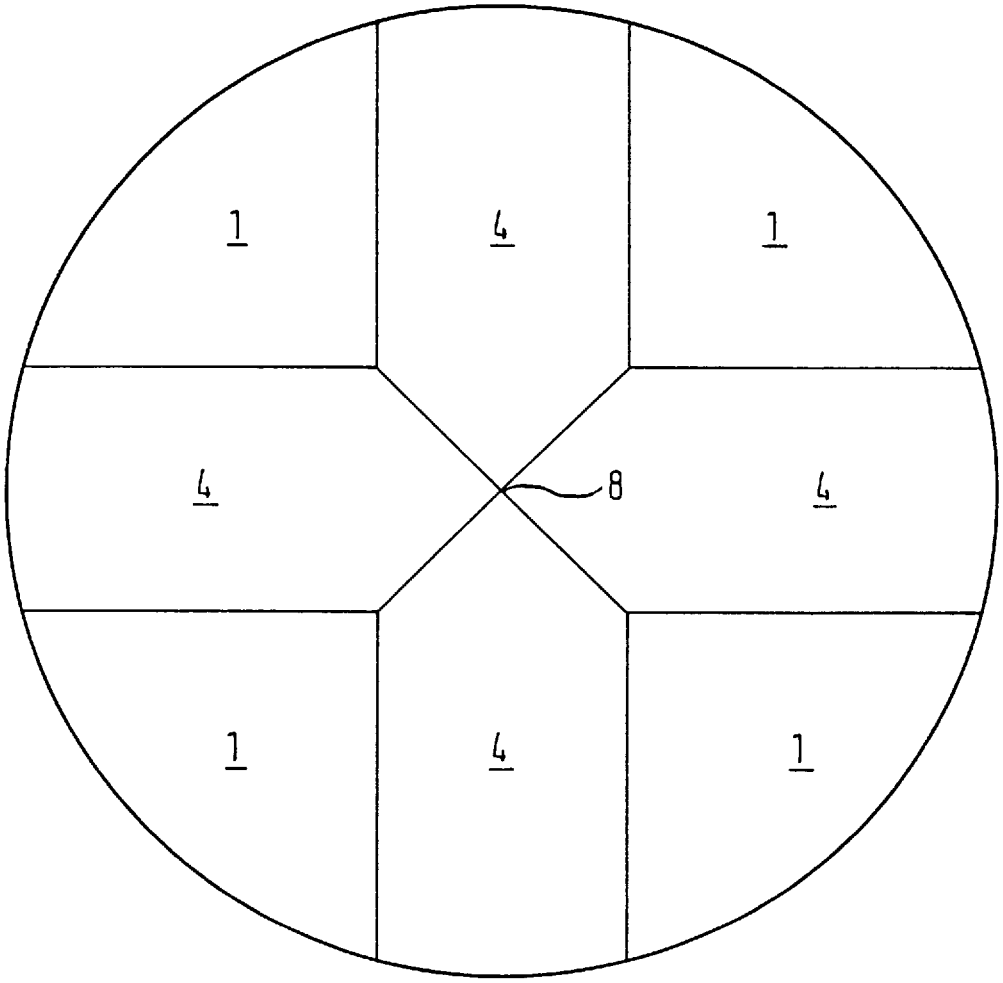
FIG. 4 is a cut-out of the plan view of FIG. 3 with an enlarged illustration.

This version is clearly illustrated in FIG. 3, which shows the top view of ball 7. Each triangular segment 1 is thus surrounded by three hexagonal segments 4. The coinciding point 8 of four rectangular segments 4 is enlarged in FIG. 4 for reasons of clarity.

Figure 5:
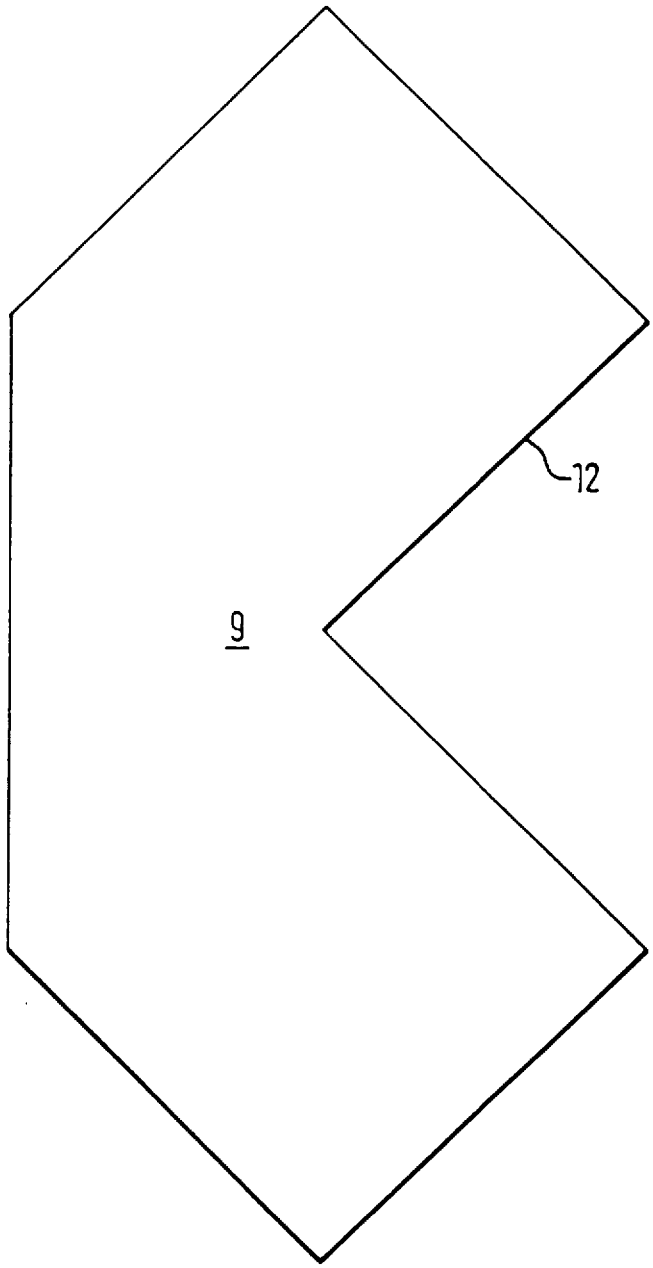
FIG. 5 is an elevation view of an alternative embodiment of the hexagonal segment according to FIG. 2.
Figure 6:
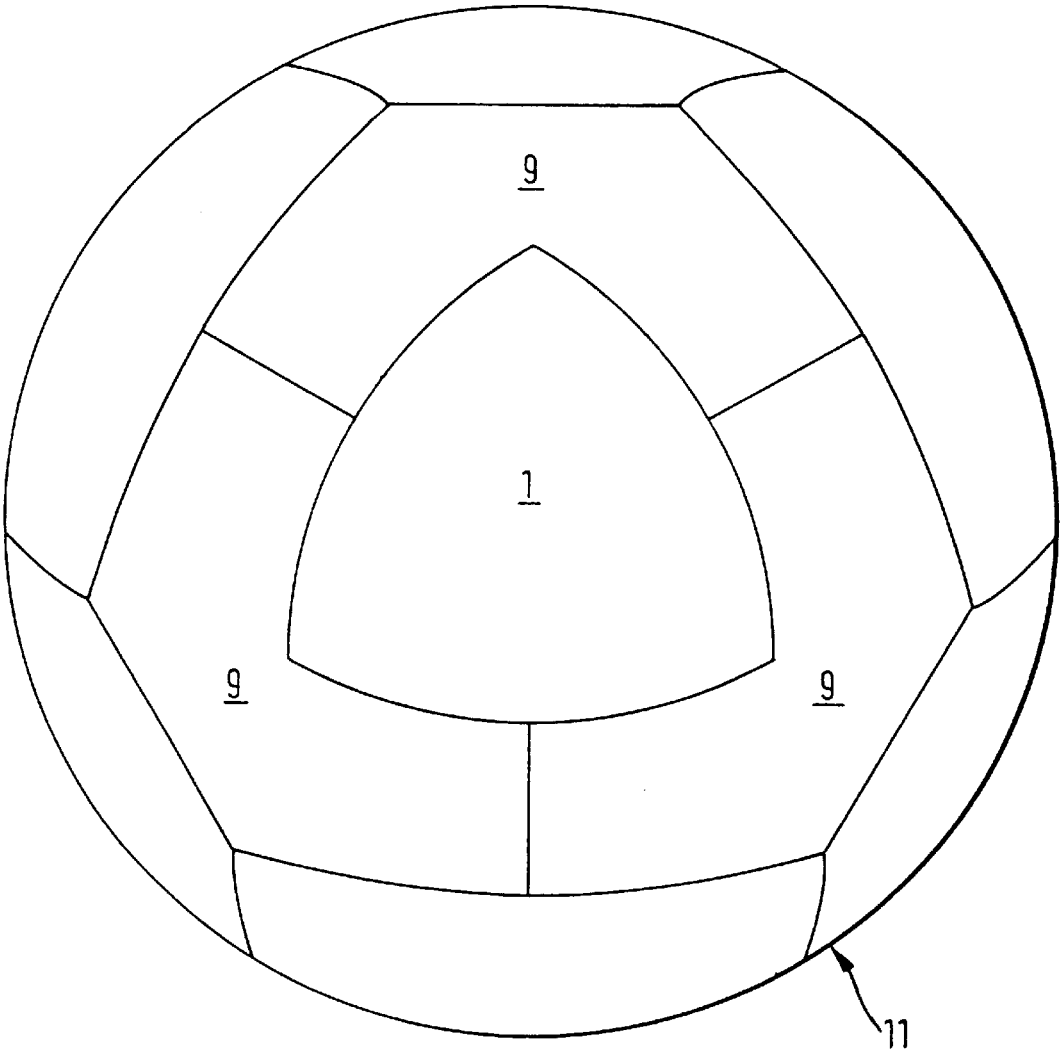
FIG. 6 is a plan view of a ball according to the present invention, consisting of the segments according to FIGS. 1 and 4.

FIG. 5 shows a different embodiment of a hexagonal segment 9. As can be seen, one of the two sides of the rectangle portion between the two triangle portions has been punched-out so that in the recess 12, a corner of the triangular segment 1 fits in. Arrangement of segments 1 and hexagonal segments 9 is illustrated in FIG. 6, which shows a top view of the ball 11 formed in such a manner. Also in this version each triangular segment 1 is surrounded by three hexagonal segments 9.

It is claimed:

1. A ball envelope made up of a plurality of polygonal segments sewn together at their edges and which belong to first and second groups of segments having different shapes, the first group of polygonal segments being made up of equilateral, triangular segments and the second group of polygonal segments being made up of hexagonal segments, the hexagonal segments having an outline corresponding to a rectangle, having long sides and short sides, interposed between two isosceles triangles, the short sides of the rectangle coinciding with the bases of the isosceles triangles.

2. A ball envelope according to claim 1, wherein edges of the triangular segments have a slightly convex shape.

3. A ball envelope according to claim 1, wherein the long sides of the rectangles of each hexagonal segment are connected to edges of the triangular segments.

4. A ball envelope according to claim 1, wherein sides of the isosceles triangles of each hexagonal segment are connected to sides of the isosceles triangles of other hexagonal segments.

5. A ball envelope according to claim 1, comprising twelve hexagonal segments and eight triangular segments.

6. A ball envelope according to claim 1, wherein respective areas of the triangular segments and the hexagonal segments are substantially of equal size.

7. A ball envelope according to claim 1, wherein each triangular segment is surrounded by three hexagonal segments.

8. A ball envelope according to claim 1 wherein both triangles of each hexagonal segment are congruent to each other.

9. A ball envelope made up of a plurality of polygonal segments sewn together at their edges and which belong to first and second groups of segments having different shapes, the first group of polygonal segments being made up of equilateral, triangular segments, and the second group of polygonal segments having an outline corresponding to a pentagon interposed between two isosceles triangles, wherein the bases of the isosceles triangles coincide with first and second sides of the pentagon and being parallel to each other, wherein the first and second sides of the pentagon are connected to a third side of the pentagon, both the first and second sides forming a right angle with respect to the third side, and wherein a fourth side and fifth side are connected to each other, the fourth side being connected to the first side of the pentagon and forming an acute angle therewith, while the fifth side is connected to the second side of the pentagon and forms an acute angle therewith.

10. A ball envelope according to claim 9 wherein both isosceles triangles are congruent to each other.

* * * * *